US005931065A

United States Patent [19]

Jackson et al.

[11] Patent Number: 5,931,065

[45] Date of Patent: Aug. 3, 1999

[54] HAND TOOL WITH AXIALLY REPOSITIONABLE SHAFT

[76] Inventors: Roger Lee Jackson, 943 E. Paulson, Lansing, Mich. 48906-2036; Mark E. Jackson, 1311 Hickory Rd., Lansing, Mich. 48906

[21] Appl. No.: 08/858,348

[22] Filed: May 19, 1997

[51] Int. Cl.[6] ..... B25B 23/16

[52] U.S. Cl. ..... 81/177.2; 81/177.1

[58] Field of Search ..... 81/177.1, 177.2, 81/104, 108, 109, 326, 330, 376, 377, 378; 403/379

[56] References Cited

U.S. PATENT DOCUMENTS

| | | | |
|---|---|---|---|
| 1,030,592 | 6/1912 | Leland . | |
| 1,269,413 | 6/1918 | Finnigan | 81/177.2 |
| 1,370,820 | 2/1921 | Johnson | 81/177.2 |
| 1,753,441 | 4/1930 | More House | 81/177.2 |
| 2,592,978 | 4/1952 | Trimboli . | |
| 2,758,494 | 8/1956 | Jenkins . | |
| 2,869,410 | 1/1959 | Prichard . | |
| 2,963,930 | 12/1960 | Clothier et al. . | |
| 3,306,639 | 2/1967 | Lyon . | |
| 4,409,866 | 10/1983 | McBride . | |
| 4,602,890 | 7/1986 | Duda . | |
| 5,033,337 | 7/1991 | Thomas, III | 81/177.2 |
| 5,099,721 | 3/1992 | Reddy, Jr. | 81/177.2 |
| 5,109,737 | 5/1992 | Raber . | |
| 5,431,075 | 7/1995 | Cruz et al. | 81/177.1 |
| 5,533,429 | 7/1996 | Kozak | 81/438 |

*Primary Examiner*—David A. Scherbel
*Assistant Examiner*—Joni B. Danganan
*Attorney, Agent, or Firm*—Gifford, Krass, Groh, Sprinkle, Anderson & Citkowski, P.C.

[57] ABSTRACT

A hand tool for providing telescoping and axial repositioning of an elongate shaft relative to a handle. The handle includes a first closed end and a second open end which defines a hollowed and axially extending interior within which is securably mounted an intermediate sleeve. The elongate shaft includes a first end which is inserted within the handle and sleeve and a second fastener bit engaging end. A plurality of individual apertures are formed along a selected surface of the elongate shaft and are arranged in axially and spaced apart fashion. A lever mechanism is mounted within apertures in the handle and sleeve and includes a detent which seats within a selected one of the individual apertures in the shaft to maintain the shaft in a locked position. A spring biases the detent in the locked position and is counteracted by a trigger which is depressed to unseat the detent from its associated aperture and to permit the elongate shaft to be axially repositioned and the detent subsequently reseated in a further selected aperture of the shaft which defines a desired and axially repositioned length of the shaft.

5 Claims, 5 Drawing Sheets

HAND TOOL WITH AXIALLY REPOSITIONABLE SHAFT

BACKGROUND OF THE INVENTION

1. Field of the Invention

The present invention relates generally to hand tools and, more specifically, to an improved hand tool for enabling a user to apply a greater degree of force through an axially repositionable shaft and further providing a heavy duty shaft adjustment mechanism which is recess mounted in an unobtrusive fashion within an elongate handle.

2. Description of the Prior Art

The prior art is well documented with numerous examples of hand tools and torque rod assemblies, each of which include some form of gripping handle member for axially receiving therein an elongate shaft portion displaying a tool engaging end and further having a mechanism of some sort for permitting selected axial repositioning of the shaft portion inwardly and outwardly of the handle. The professed advantage of such tools is to permit the shaft to be selectively and axially readjusted in inward and outward fashion relative to the outer gripping member in response to whatever space restrictions are presented in a surrounding operating environment.

U.S. Pat. No. 4,409,866, issued to McBride, teaches a tool assembly including a handle with a spring biased trigger means for permitting a selected insertable shank tool to be readjusted in an axial manner. The handle includes a through passageway substantially along its longitudinal axis and a cross section of an associated shank tool is sized so that it is slidably insertable within the handle. The tool handle further includes a body provided with a U-shaped trigger, a forward leg of which is movable in a transverse slot extending therethrough the passageway in and through the handle and includes an aperture formed therein which is adapted to permit the shank of the tool to pass therethrough. A plurality of spaced apart notches are formed along an underside surface of the shank tool and are selectively engaged by the forward leg portion. A rear trigger leg also includes a small aperture which is engaged by a pin and the "U" shaped trigger member is biased in an upward direction by a coil spring which is mounted within a recess open to an exterior of the handle and pressing upwardly against the underside surface of the base member of the "U" shaped trigger so that the trigger member is displaced a considerable distance above the level surface of the handle.

While disclosing an effective shaft repositioning device, the trigger assembly in McBride suffers from the shortcoming that the coil spring element which biases the trigger assembly projects outwardly from the recess mount a significant degree to a point exterior of the surface of the handle where it biases against the underside of the trigger. Having a coil spring in such an exposed arrangement is potentially harmful in that it could possibly slip out of alignment with the interconnecting base member of the "U" shaped trigger, causing the telescoping shaft to lose its retaining engagement with the handle. A further shortcoming of McBride involves the amount of biasing force that can be exerted by the spring and through the forward leg held within the selected notch in the shank without disengaging the shaft from the trigger. It is submitted that McBride does not teach a heavy-duty engaging mechanism for repositionally securing the shaft in axial fashion to the handle.

U.S. Pat. No. 2,592,978, issued to Trimboli, also discloses an interesting retractable tool device which includes a repositionable shank portion which is held within a handle. The shank includes a plurality of spaced apart and grooved slotted portions and a cylindrical head portion of the handle includes a spherical ball detent member which is biased inwardly by a spring so that it seats within a selected slotted portion. While illustrating an interiorly positioned spring member and detent, Trimboli suffers from the disadvantage that the spherical ball and spring arrangement also does not provide a heavy-duty type securing means for preventing inadvertent axial displacement of the shaft relative the gripping handle upon the application of an excessive degree of force, such as is necessary when loosening a partially corroded screw or like fastener.

SUMMARY OF THE PRESENT INVENTION

The present invention is a hand tool assembly with heavy duty locking means for axial repositioning of an elongate shaft relative to a tool handle which is an improvement over the disclosures of McBride and Trimboli. The tool assembly includes an elongate outer handle having a first closed end and a second open end which defines a hollowed and axially extending interior. An apertured portion is formed within the outer handle in an axially extending manner and communicates an exterior facing surface of the handle with the axially extending interior. An intermediate sleeve is securably mounted in a coaxially insertable fashion within the axially extending interior of the handle. The intermediate sleeve defines an open and elongate interior which is polygonal shaped in cross section and the sleeve further includes a like apertured portion which extends in an axial manner so that, upon coaxial insertion of the intermediate sleeve within the axial interior of the handle, the apertured portion of the sleeve aligns with the apertured portion of the handle in order to communicate the exterior facing surface of the handle with the open and elongate interior of the sleeve.

An elongate shaft includes a first inserting end and a second fastener bit engaging end. The inserting end of the shaft is slidably engaged within open and elongate interior defined within the handle so that the fastener bit engaging end projects a selected axial distance from the handle. The shaft is defined by a polygonal shape in cross section which is contoured to match the cross sectional shape of the sleeve and prevents the occurrence of rotational displacement or dislocation between the shaft and the sleeve and outer handle. A plurality of individual apertures are formed along a selected surface of the elongate shaft and are arranged in an axially and spaced apart fashion.

A lever mechanism is positioned within the aligning apertured portions in the handle and intermediate sleeve and is arranged in a substantially level fashion with respect to the exterior facing surface of the outer handle. The lever mechanism according to a first preferred embodiment is a pivot member which is secured by a transversely mounted pin to the handle. A coil biasing spring is mounted at a first end of the pivot member and biases the associated end of the pivot member upwardly so that a detent extending from an opposite and downwardly biased end is seated within a selected one of the plurality of individual apertures in the shaft in an engaged position. The pivot member is depressed at its first end so that the detent rotates in an upward and unseating position from its associated aperture, releasing the elongate shaft from its locking arrangement with the handle and intermediate sleeve. The shaft may then be axially repositioned in either an inwardly or outwardly fashion until a desired repositioned length is achieved, upon which the pivot member is released and the detent once again rotates downwardly due to the upwardly biasing action of the spring to reseat within a further selected one of the plurality of apertures.

The lever mechanism according to a second preferred embodiment is a substantially planar shaped plate member which is mounted to the handle and intermediate sleeve in a substantially perpendicular fashion relative to the longitudinally extending direction of the sleeve and handle. The planar shaped plate member is formed with a central aperture which is dimensioned to permit the elongate shaft to extend therethrough and is further capable of being actuated to a limited extent in both an upward and downward direction. A detent projects from an inwardly facing surface of the central aperture and is received within a selected one of the plurality of individual apertures formed at spaced increments along the shaft. Biasing the detent in a seating position within its selected shaft aperture is a coil spring which is mounted within the handle and biases against an opposing and outer facing surface of the plate shaped member. An actuating portion of the plate shaped member extends from an outer surface of the plate shaped member opposite the coil spring and detent. A trigger of the actuating portion projects a sufficient minor distance from or is substantially flush with the level surface of the handle and is depressed so that the biasing force of the spring is reversed and the detent is unseated from its selected individual shaft aperture and the shaft axially repositioned. Following axial repositioning of the shaft, the trigger is released and the coil spring once again biases the plate shaped member to seat the detent into a second selected aperture corresponding to the desired repositioning length of the shaft relative to the handle and sleeve.

BRIEF DESCRIPTION OF THE DRAWING

Reference will now be had to the attached drawing, when read in combination with the following specification, wherein like reference numerals refer to like parts throughout the several views, and in which.

DESCRIPTION OF THE PREFERRED EMBODIMENTS

Figure 1:
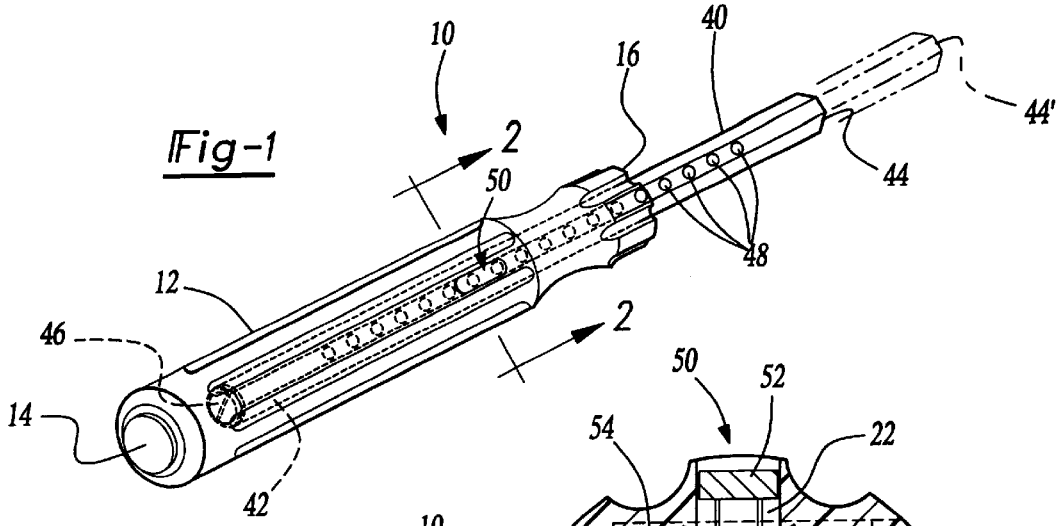
FIG. 1 is a perspective view of the hand tool with axially repositionable shaft according to a first preferred embodiment of the present invention.
Figure 2:
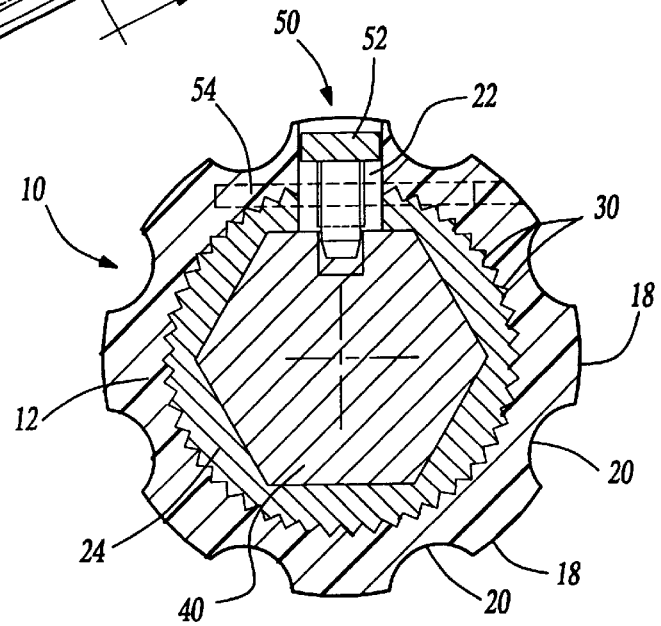
FIG. 2 is a cutaway view taken along line 2—2 of FIG. 1 and illustrating a cutaway of the hand tool at a forward axial location which shows the releasably locking engaging of the lever mechanism according to the first preferred embodiment.
Figure 3:
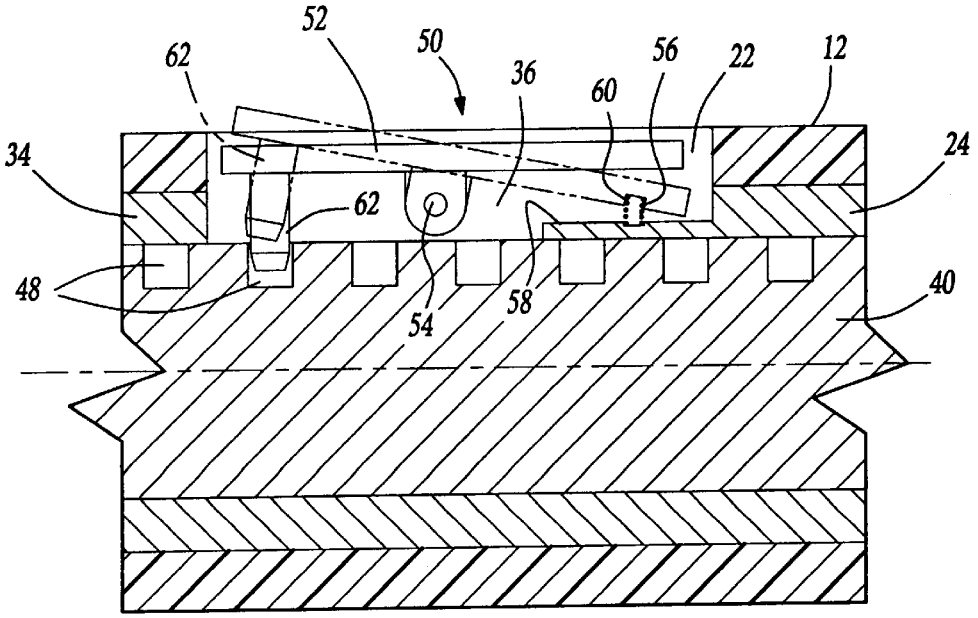
FIG. 3 is a sectional view of the lever means according to the first preferred embodiment and illustrates the pivoting arrangement of the lever with the biasing coil spring and inwardly facing detent engaging portion.
Figure 4:
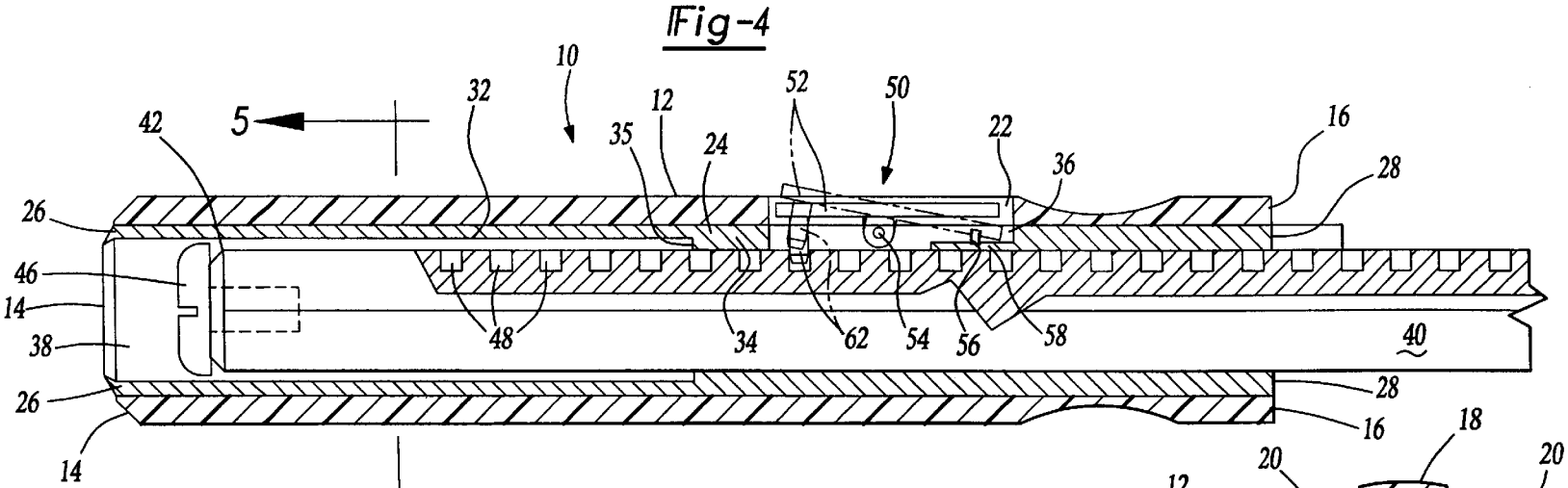
FIG. 4 is a longitudinal view in cutaway and illustrating the range of axial repositioning of the elongate shaft relative to the handle and intermediate sleeve.
Figure 5:
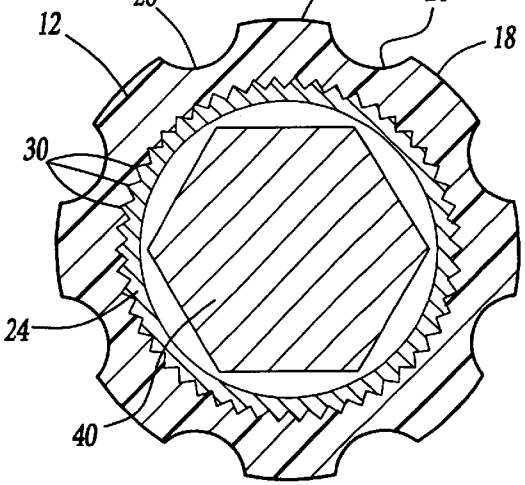
FIG. 5 is a cutaway view taken along line 5—5 of FIG. 4 and illustrating the concentric nature of the outer handle, intermediate sleeve and elongate shaft at a rearward axial location.
Figure 6:
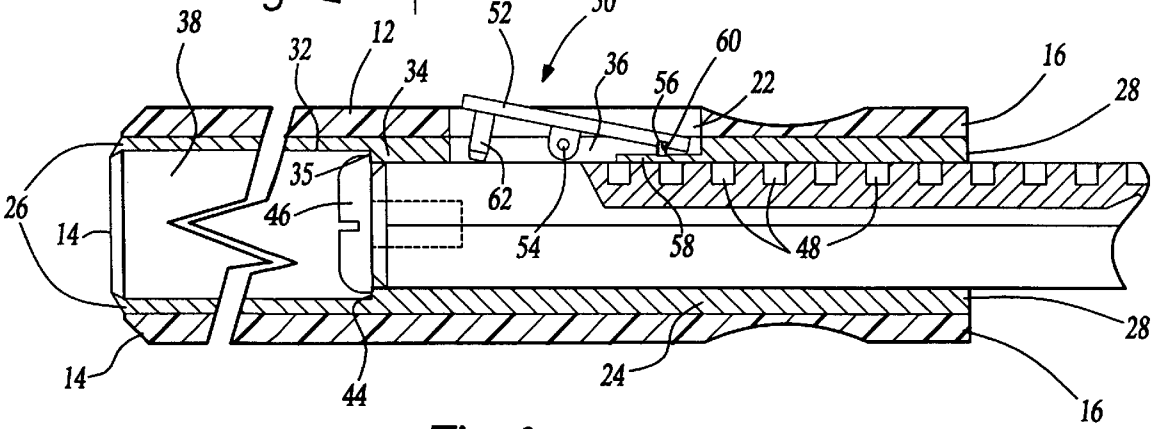
FIG. 6 is a view of the hand tool in cutaway and in reduced section which is similar to that shown in FIG. 4 and further illustrates an abutting stop between the elongate shaft and the open end of the hand tool which prevents axial removal of the shaft from the handle.

Referring now to FIGS. 1–3, a hand tool 10 with axially repositionable shaft is illustrated according to a first preferred embodiment of the present invention. Although illustrated in side cutaway view in FIGS. 3, 4, 6 and 7, the elongate outer handle 12 is substantially cylindrically shaped consistent with FIGS. 1, 2, and 5 and includes a first closed end 14 and a second open end 16 which defines a hollowed and axially extending interior. Referring specifically to FIGS. 2 and 5, the handle 12 may include alternating plateau portions 18 and recessed portions 20 arranged around its outer circumference to facilitate gripping by a user. The handle 12 is further constructed of a conventional material such as a durable and hardened plastic or polymer, etc. As is also best illustrated in FIGS. 3 and 6, the outer handle 12 includes a first apertured portion 22 which is formed in an axially extending and elongate slotted fashion within the handle 12 at a select location and which communicates the exterior facing surface of the handle 12 with its hollowed and axially extending interior.

An intermediate sleeve 24 is provided and is shaped in a hollow sleeve-like manner similarly to the outer handle 12. The sleeve 24 likewise includes a first rearward end 26 and a second forward end 28 and is securably mounted in a coaxially inserting fashion within the axially extending interior of the outer handle 12. The sleeve 24 is preferably constructed of a steel or aluminum composite metal for providing strength and durability and, as is best shown in FIGS. 2 and 5, a plurality of serrations 30 are arranged around an outer circumference of the sleeve 24 and facilitate mounting of the intermediate sleeve 24 within the handle 12 in a secure and rotatingly resistive manner. As is also best seen from FIGS. 4 and 6, the intermediate sleeve 24 is made up of a first rear cylindrical section 32 and a second outwardly stepped forward cylindrical section 34 which is defined by an annular shoulder 35. Referring to FIG. 3, a second apertured portion 36 is formed within the sleeve 24 in an aligning manner relative to allocation of the first apertured portion 22 upon mounting the sleeve 24 within the handle 12 and communicates the exterior facing surface of the handle 12 with an open and elongate interior 38 of the sleeve 24 and which corresponds to a selected location of an inserting shaft as will be subsequently described (see FIGS. 4 and 6). The apertured portion 36 is preferably a recess formed within an otherwise solid construction of the sleeve.

An elongate shaft 40 constructed of a similar steel or aluminum composite or plastic, etc., in comparison to the sleeve 24 is provided and includes a first inserting end 42 and a second fastener bit engaging end 44. The shaft 40 is substantially polygonal shaped in cross section, preferably being either a rectangular or hexagonal shape, and is slidably engaged within the handle 12 and intermediate sleeve 24 so that the shaft 40 forms a mating, axially slidable and rotational resistant engagement with a similarly cross sectionally shaped second and outwardly stepped forward portion of the cylindrical section 34 of the sleeve 24 (see FIG. 2). Attached to the first inserting end 42 of the shaft 40 is an enlarged end portion 46 which provides the function of permitting the shaft 40 to axially translate in a range extending between forward and rearward ends of the first rear cylindrical section 32 of the sleeve 24. When axially slided to a forward-most position, the enlarged end portion 46 abuts against the annular shoulder 35 of outwardly stepped forward cylindrical section 34 and in a rearmost axially slided position abuts against the closed rear ends 14 and 26 of the handle 12 and sleeve 24, respectively. It is also understood that the rear ends 14 and 26 may likewise be opened such as by providing a threaded screw cap (not shown) as is commonly known in the art and provision of such an element may facilitate desired insertion and removal of the shaft 40 from within the handle and sleeve assembly. The first inserting end 42 can alternatively be provided as a snap ring (not shown) for providing axially translating and abutting support of the shaft and can further permit the shaft to be removed from the handle and sleeve and replaced with a similarly configured shaft displaying a differently configured tool bit engaging end so that different shafts can be employed. Also, other means such as ball and spring engagement, etc., can be employed.

Arranged in axially extending fashion along a selected surface of the shaft 40 and at spaced apart increments are a plurality of individual apertures 48. As is best illustrated in the partial cutaway of FIG. 4, spaced apart apertures 48 are located in a range along the axially extending exterior of the shaft 40 which correspond to the range of forward and rearward axial repositioning of the shaft 40 as permitted by the enlarged end portion 46 and shoulder abutting stop 35. The apertures 48 are also each communicated with the first and second apertured portions 22 and 36 upon a selected axial repositioning of the shaft 40 as will be subsequently described.

A lever mechanism is provided for releasably and repositionally locking the elongate shaft 40 in a desired axial arrangement to the handle 12 and intermediate sleeve 24. According to the first preferred embodiment and as is most clearly shown in FIG. 3, the lever mechanism is a pivot member assembly 50 which is secured within the first apertured portion 22 of the handle 12 which includes an elongate arm 52 which is mounted by a transversely extending pin 54 to the body of the handle 12 (see also the side cutaway of FIG. 2). A coil spring 56 is provided at a forward end of the elongate arm 52 and is secured at one end to a base support 58 of the handle 12 and at the other end within a recess 60 in the underside of the elongate arm 52. A portion of the sleeve is removed in the side view of FIGS. 4 and 6 to more clearly illustrate the nature of the pivot mechanism.

The coil spring 56 biases the forward end of the elongate arm 52 in an upward direction so that a downwardly facing detent 62 having any desired configuration is located at a corresponding rearward end of the arm 52 and is downwardly rotated and seated within a selected one of the plurality of shaft apertures 48 which is revealed by the second apertured portion in the sleeve and which are shaped identical to the cross-section shape of the engaging detent. The pivot assembly 50 is easily operated simply by the user applying pressure with the thumb against the forward end of the elongate arm 52, causing reverse biasing force against the spring 56 and the detent 62 to rotate in an upward and unseating direction from its associated shaft aperture 48. The shaft 40 may then be axially repositioned in a desired forward or rearward direction, such as is illustrated in forwardly repositioned end 44' of the shaft 40 in FIG. 1, until a further selected aperture 48 is aligned with the detent 62, upon which the applying pressure is released and the detent 62 reseats within the further selected aperture 48. As is also clearly illustrated throughout the figures, the pivot member assembly 50 in its undeflected and engaged position is arranged in a substantially level and flush manner with respect to the exterior of the handle 12 and thereby precludes the possibility of a user's hand or fingers becoming jammed against the pivot assembly 50 in the event that the hand slides forwardly in a sudden and abrupt manner as a result of downwardly pressure applied against the handle.

Figure 7:
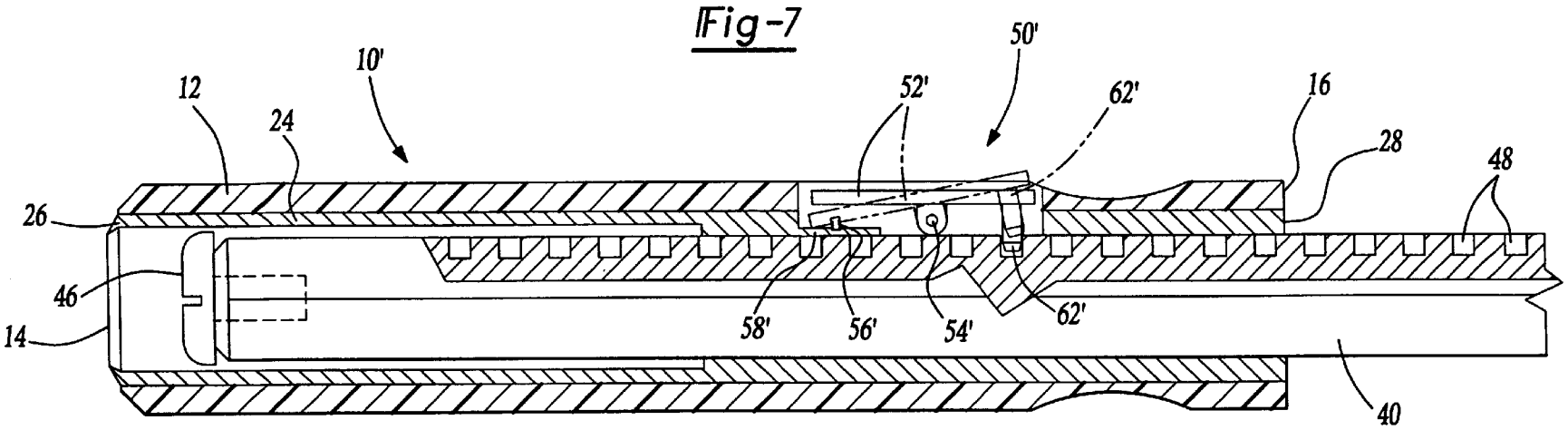
FIG. 7 is a longitudinal view in cutaway which is similar to that shown in FIG. 4 and illustrates the lever means according to the first preferred embodiment in a reversed position.

Referring to FIG. 7, a side cutaway of an alternate configuration 10' of the hand tool is illustrated which is similar in substantially every respect to the initial configuration with the exception that the pivot assembly is reversed in position to an arrangement shown at 50' relative to the handle 12 and sleeve 24. A spring 56' is supported upon a thin annular and forwardly extending base support 58' of the handle 12 located at a rearward end of an elongate arm 52' and biases a downwardly extending detent 62' at a corresponding forward end of the arm 52' within its associated shaft aperture 48. The sleeve 24 is illustrated in partially removed fashion surrounding the lever mechanism to clearly illustrate the attachment of the pivot and arm to the handle. The major advantage of the configuration 10' of the pivot assembly 50' with forwardly directed detent 62' is that the detent is now capable of engaging an additional small plurality of apertures 48 which in the first configuration would be positioned forwardly of the detent when the shaft 40 is in its forward and outermost axially positioned arrangement relative to the handle and sleeve.

Figure 10:
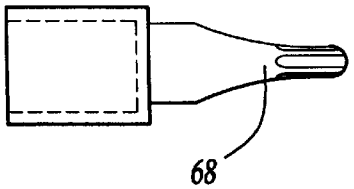
FIG. 10 is a view of a third fastener bit for attaching to an open-ended bit engaging end of the elongate shaft according to the present invention.
Figure 9:
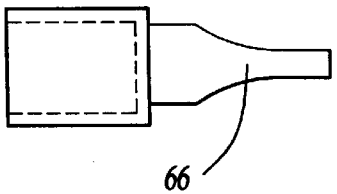
FIG. 9 is a view of a second fastener bit for attaching to an open-ended bit engaging end of the elongate shaft according to the present invention.
Figure 8:
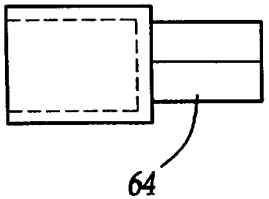
FIG. 8 is a view of a first fastener bit for attaching to an open-ended bit engaging end of the elongate shaft according to the present invention.

Referring to FIGS. 8–10, examples of differently configured fastener bit engaging portions are illustrated at 64, 66 and 68 for being selectively engaged with the second fastener bit engaging end 44 of the elongated shaft 40. As is well known in the art, the extending shaft portion of a screwdriver can be internally hollowed at its extending end such that it is capable of interchangeably mounting any one of a plurality of differently configured bit portions in a magnetically securable fashion. Such fastener bits can include any type of standard or philips shaped bits such as shown at 64 and 66, respectively, in FIGS. 8 and 9 and may also be an alien type bit such as shown at 68 in FIG. 10. It is understood that there is no limitation on the quantity and type of fastener bit which can be used with the hand tool of the invention and in fact it is possible to store a plurality of such bits, such as within a rear open cavity of the hand tool which is accessed by a rearwardly threadably mounted screw cap as is known in the art.

Figure 11:
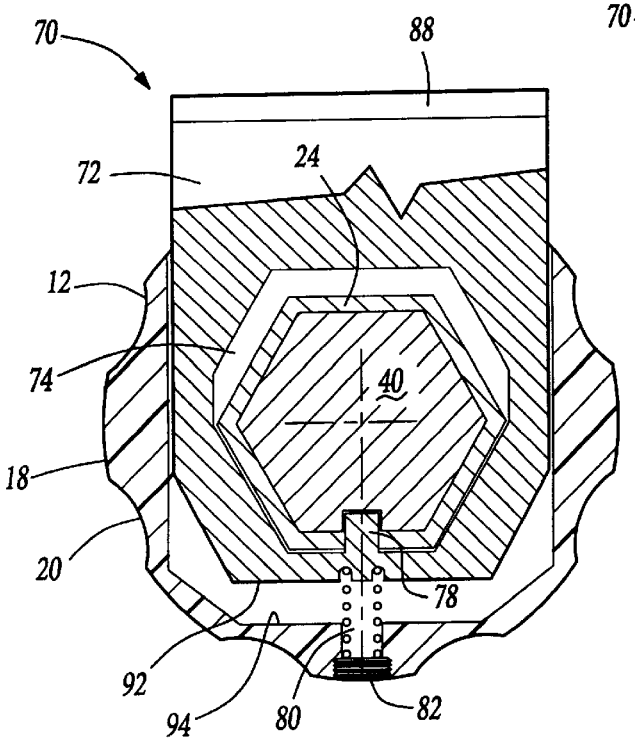
FIG. 11 is a view in cutaway of the hand tool and illustrating a plate shaped releasably lockable lever mechanism with detent in a seated position according to a further preferred embodiment of the present invention.
Figure 12:
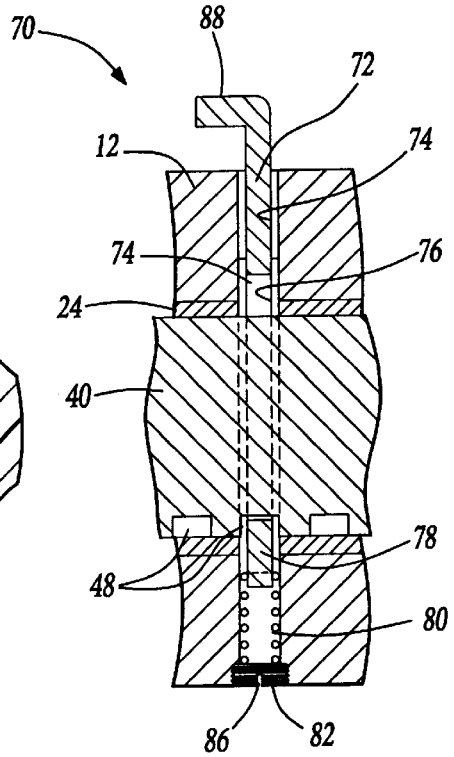
FIG. 12 is a side view of the lever mechanism illustrated in FIG. 11 and illustrating the projecting trigger and biasing coil spring and engaging detent.
Figure 13:
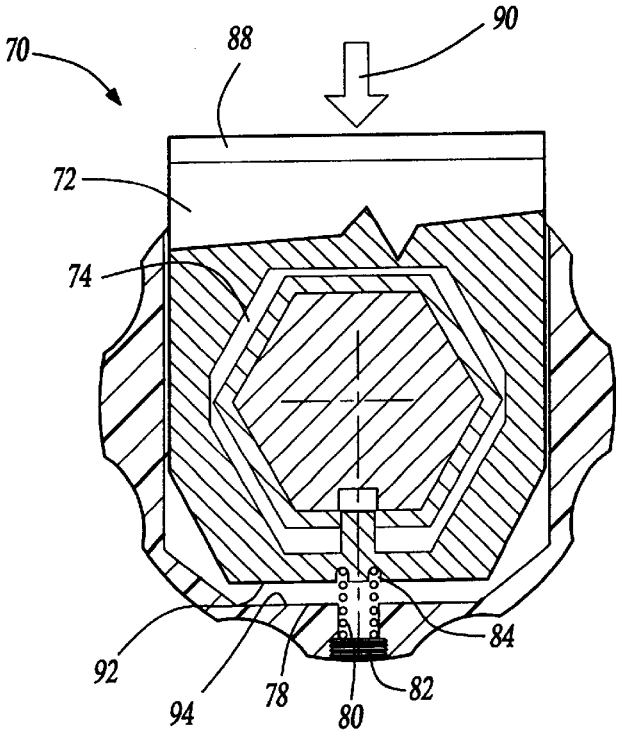
FIG. 13 is a view similar to that shown in FIG. 11 and illustrating the trigger actuated in a downward direction causing the detent to unseat from its associated shaft aperture.

Referring now to FIGS. 11–13, a lever mechanism 70 is shown for use with the hand tool according to a further preferred embodiment of the present invention. The lever mechanism 70 according to the further embodiment is intended as a substitute for the pivot member assembly 50 of the first embodiment and the remaining features of the hand tool, including handle 12, sleeve 24 and shaft 40 remain substantially unchanged except as is now described.

The lever mechanism 70 includes a substantially planar shaped, and preferably rectangular, member 72 having a polygonal shaped central aperture 74 which is shaped similar in cross section to the cross sectional shape of the elongated shaft 40 (either square or hexagonal, etc., which is shown) extending therethrough and is dimensioned so as to permit the planar shaped member 72 a limited degree of upward and downward actuation. As is best shown in FIG. 12, the first and second aligning and apertured portions of the handle 12 and sleeve 24 are illustrated at 74 and 76 through which the planar shaped member 72 is permitted to vertically actuate.

The elongated shaft 40 is positioned such that its row of axially spaced apart and longitudinally extending apertures 48 is arranged along a bottom side of the shaft 40. A detent 78 extends upwardly from an associated bottom edge surrounding the central aperture 74 of the plate shaped member 72 and is seated within a selected shaft aperture 48 through upwardly directed biasing of a coil spring 80. A lower end of the coil spring 80 is seated upon a bottom internal support 82 in the handle and a corresponding upper end is seated within an annular groove 84 in the plate shaped member 72 along an edge opposite the inwardly directed detent 78. As is also shown in FIG. 12, the internal support 82 may be threadably engaged relative to the handle and a slot 86 may permit a flat edged screwdriver bit to adjust the inward or outward seating of the support 82, the effect of which will adjust the amount of upward bias which is exerted by the spring 80 or to replace the spring 80 if necessary.

The planar shaped member 72 terminates along an upper edge thereof in an inwardly turned trigger 88 and provides the user with the ability to downwardly actuate the planar shaped member 72 from an upwardly biased and seated position of the detent 78 within its associated shaft aperture 48 as shown in FIG. 11 to a direction as illustrated by arrow 90 in FIG. 13 in which the force of the spring is reverse biased and the planar shaped member 72 is downwardly actuated until its bottom most edge 92 is in abutting contact with a bottom surface 94 of the handle, at which point the detent 78 is actuated to an unseated position which permits axial repositioning of the shaft in both inwardly and outwardly axial directions. As is clearly evident in the side view of FIG. 12, the shaft is in an abutting and rotatively preventative arrangement with respect to the handle and intermediate sleeve on either side of the planar shaped member 72 and is capable of only being repositioned in axial fashion once the planar shaped member 72 is unseated from the selected shaft aperture 48. The contour of the upper portion of the planar member 72 and trigger 88 is further such that it projects only a minimal degree beyond the exterior surface of the handle 12 and maintains the overall flush appearance of the handle.

Figure 14:
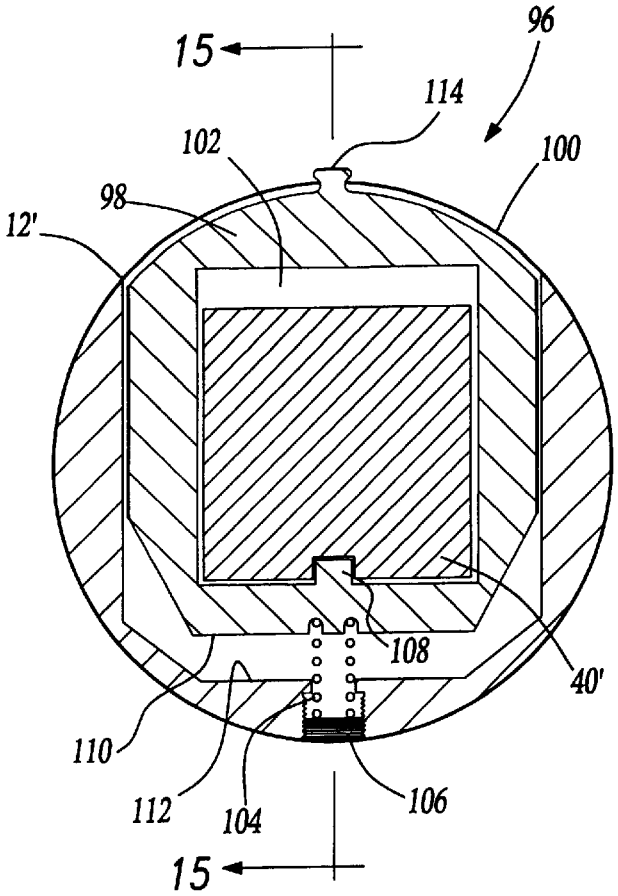
FIG. 14 is a view similar to that shown in FIG. 11 and illustrating a square shaped elongate shaft in cross section and plate shaped lever mechanism with alternatively configured central aperture and trigger according to a further variant of the second preferred embodiment of the present invention.
Figure 15:
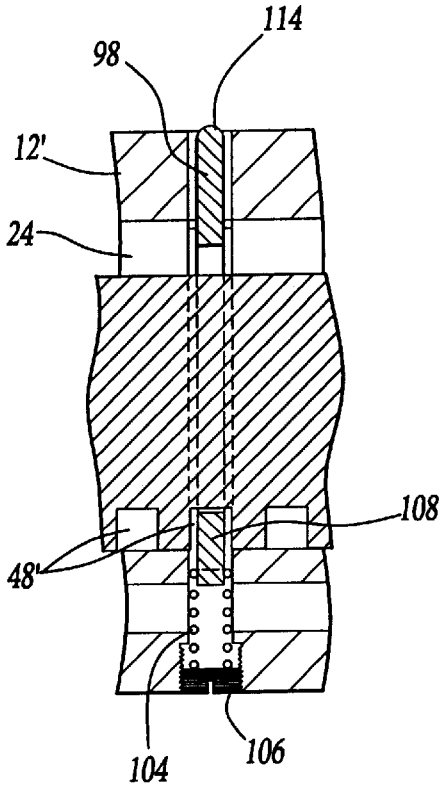
FIG. 15 is a cutaway view taken along line 15–15 of FIG. 14 and illustrating in side profile the lever mechanism according to the further variant of the second preferred embodiment of the present invention.

Referring finally to FIGS. 14 and 15, a lever mechanism 96 is illustrated according to a still further available variant of the second preferred embodiment of the invention. The lever mechanism 96 includes a planar shaped member 98 which is similar in arrangement and operation to the planar shaped member 72 of the embodiments of FIGS. 11–13. The planar shaped member 98 differs however from the member 72 in the previous embodiment in that its outer circumference is dimensioned so that it aligns in a substantially flush manner with a corresponding smooth outer surface 100 of a handle 12'. The member 98 and handle 100 are each substantially rectangular shaped as shown in FIG. 14 and the planar member 98 is dimensioned with a central aperture 102 which is also rectangular shaped in cross section and receives therethrough a rectangular cross sectional shaped shaft 40' such that the planar member 98 is permitted a marginal degree of upward and downward actuating motion.

A coil spring 104 is seated upon a bottom support 106 within the handle 12' and biases the planar member 98 such that an inwardly directed detent 108 extends from an inner and opposite side of the member 98 relative to an outer bottom side 110 against which the spring 104 abuts. The planar shaped member 98 is actuated in a downward and detent unseating direction and towards a bottom edge surface 112 of the handle 12' by a trigger 114 which is located at a corresponding top circumferential location extending from the exterior surface of the handle 12'. The trigger 114 is contoured such that it projects only a minimal extent beyond the exterior flush surface of the handle 12' and provides a consistent exterior surface as with the other preferred embodiments.

Having described my invention, additional preferred embodiments will become apparent to those skilled in the art to which it pertains without deviating from the scope of the appended claims. Specifically, other types of spring biasing means could be utilized, such as leaf springs. Other types and shapes of lever mechanisms may also be employed, each of which is capable of providing heavy duty and releasably securable reinforcing engagement to the shaft. Also, a significant number of different cross sectionally shaped handle, sleeve and shaft portions could be utilized without departing from the scope of the present invention. Furthermore, as previously explained, the interchangeable tool bit portions for use with the open ended shaft can be replaced by a plurality of individual shafts each displaying a uniquely configured and integrally formed engaging portion (such as allen, philips socket, etc.), the shafts being selectively engaged within the handle and sleeve as desired. Reference is now made to the appended claims in support of the above disclosed embodiments and further preferred embodiments.

We claim:

1. A hand tool, comprising:

an elongate outer handle having a first closed end and a second open end defining a hollowed and axially extending interior, a first apertured portion being formed within said outer handle at a selected location which communicates an exterior facing surface of said handle with said axially extending interior;

an intermediate sleeve securably mounted in a coaxially inserted fashion within said axially extending interior of interior of said outer handle, said sleeve defining an open and elongate interior which is polygonal shaped in cross section, a second apertured portion being formed within said sleeve in an aligning manner relative to said first apertured portion to communicate said exterior facing surface with said open and elongate interior of said sleeve;

an elongate shaft having a first inserting end and a second fastener bit engaging end, said inserting end of said shaft being slidably engaged within said handle and intermediate sleeve so that said fastener bit engaging end projects a selected axial distance, said shaft defining a polygonal shape in cross section which is countoured to match that of said hollowed interior of said sleeve so as to prevent rotational dislocation occurring between said shaft and said sleeve and outer handle;

a plurality of individual apertures formed along a selected surface of said elongate shaft and being arranged in an axially and spaced apart fashion; and lever means positioned within said aligning apertured portions of said handle and intermediate sleeve and securing to said handle and intermediate sleeve in a substantially level fashion with respect to said exterior facing surface of said outer handle, said lever means including a detent which seats within a first selected one of said individual apertures in said elongate shaft and a spring which is securably attached at an interior location within said handle and sleeve and which biases said lever means in a first locking direction, said lever means further including a pivot member assembly including an elongate arm which is secured by a transversely extending pin member to said handle, a coil spring securing to said handle and upwardly biasing a first end of said elongate arm on one selected side of said elongate arm and downwardly biasing a second end of said elongate arm on an opposing side of said pin member such that said elongate arm is arranged in a substantially level and flush manner with respect to said exterior facing surface of said outer handle, said detent projecting downwardly from said second end of said arm and seating within said first selected aperture of said shaft;

said lever means being actuated in a second and opposite releasing direction to unseat said detent from said first selected aperture and to permit said shaft to be axially repositioned selectively in both inward and outward fashion along said open elongate interior of said sleeve, said lever means being released so that said detent reseats within a second selected aperture.

2. The hand tool as described in claim 1, further comprising said fastener bit engaging end of said elongate shaft having an open interior, a plurality of fastener bit inserting portions each having a uniquely configured fastener engaging portion being selectively and releasably securably attached within said open interior of said fastener bit engaging end.

3. The hand tool as described in claim 1, said elongate shaft and said intermediate sleeve each defining a hexagonal shape in cross section.

4. The hand tool as described in claim 1, said elongate shaft and said intermediate sleeve each defining a rectangular shape in cross section.

5. The hand tool as described in claim 1, said elongate outer handle including pluralities of alternating plateaus and semi-circular recesses arranged in circumferential fashion for facilitating improved gripping.

* * * * *